US005922528A

United States Patent [19]

Weaver et al.

[11] Patent Number: 5,922,528

[45] Date of Patent: Jul. 13, 1999

[54] THERMOGRAPHIC IMAGING ELEMENT

[75] Inventors: Thomas D. Weaver, Rochester; David F. Jennings, Penfield, both of N.Y.

[73] Assignee: Eastman Kodak Company, Rochester, N.Y.

[21] Appl. No.: 09/045,406

[22] Filed: Mar. 20, 1998

[51] Int. Cl.[6] ..... G03C 1/498

[52] U.S. Cl. ..... 430/617; 430/619

[58] Field of Search ..... 430/617, 619

[56] References Cited

U.S. PATENT DOCUMENTS

| | | | |
|---|---|---|---|
| 3,753,395 | 8/1973 | Poot et al. . | |
| 3,767,414 | 10/1973 | Huffman et al. . | |
| 3,996,397 | 12/1976 | Laridon et al. . | |
| 4,013,473 | 3/1977 | Willems et al. . | |
| 4,076,534 | 2/1978 | Noguchi et al. . | |
| 4,082,901 | 4/1978 | Laridon et al. . | |
| 5,358,843 | 10/1994 | Sakizadeh et al. | 430/619 |

FOREIGN PATENT DOCUMENTS

| | | |
|---|---|---|
| 654355 | 11/1993 | European Pat. Off. . |
| 582144 | 2/1994 | European Pat. Off. . |
| 677775 | 3/1994 | European Pat. Off. . |
| 677776 | 3/1994 | European Pat. Off. . |
| 678775 | 3/1994 | European Pat. Off. . |
| 678760 | 5/1994 | European Pat. Off. . |
| 683428 | 4/1995 | European Pat. Off. . |
| 687572 | 5/1995 | European Pat. Off. . |
| 671283 | 9/1995 | European Pat. Off. . |
| 671284 | 9/1995 | European Pat. Off. . |
| 674217 | 9/1995 | European Pat. Off. . |
| 713133 | 5/1996 | European Pat. Off. . |
| 1451403 | 10/1976 | United Kingdom . |
| 2083726 | 3/1982 | United Kingdom . |
| 94/14618 | 7/1994 | WIPO . |

OTHER PUBLICATIONS

Anonymous: "Photothermographic Element, Composition and Process," Research Disclosure, vol. 105, No. 13, Jan. 1973, pp. 16–21.

U.S. application No. 08/770,750, Weaver et al., filed Dec. 19, 1996.

*Primary Examiner*—Thorl Chea

*Attorney, Agent, or Firm*—Edith A. Rice

[57] ABSTRACT

A thermographic imaging element comprising:

(a) a support; and (b) an imaging layer comprising:

(i) an oxidizing agent;

(ii) a first reducing agent; and (iii) a second reducing agent comprising a silicon compound containing at least one silicon-hydrogen bond.

12 Claims, 1 Drawing Sheet

THERMOGRAPHIC IMAGING ELEMENT

FIELD OF THE INVENTION

The present invention relates to a thermographic imaging element for use in direct thermal imaging.

BACKGROUND OF THE INVENTION

Thermal imaging is a process in which images are recorded by the use of imagewise modulated thermal energy. In general there are two types of thermal recording processes, one in which the image is generated by thermally activated transfer of a light absorbing material, the other generates the light absorbing species by thermally activated chemical or physical modification of components of the imaging medium. A review of thermal imaging methods is found in "Imaging Systems" by K. I. Jacobson R. E. Jacobson—Focal Press 1976.

Thermal energy can be delivered in a number of ways, for example by direct thermal contact or by absorption of electromagnetic radiation. Examples of radiant energy include infra-red lasers. Modulation of thermal energy can be by intensity or duration or both. For example a thermal print head comprising microscopic resistor elements is fed pulses of electrical energy which are converted into heat by the Joule effect. In a particularly useful embodiment the pulses are of fixed voltage and duration and the thermal energy delivered is then controlled by the number of such pulses sent. Radiant energy can be modulated directly by means of the energy source e.g. the voltage applied to a solid state laser.

Direct imaging by chemical change in the imaging medium usually involves an irreversible chemical reaction which takes place very rapidly at elevated temperatures—say above 100° C.—but at room temperature the rate is orders of magnitude slower such that effectively the material is stable.

A particularly useful direct thermal imaging element uses an organic silver salt in combination with a reducing agent. Such systems are often referred to as 'dry silver'. In this system the chemical change induced by the application of thermal energy is the reduction of the transparent silver salt to a metallic silver image.

PROBLEM TO BE SOLVED BY THE INVENTION

In a thermographic imaging system the range of energies available for the imaging process is quite restricted. An imaging system that requires excessive energy for the onset of imaging cannot simply have more energy applied. At high thermal energies the materials of the imaging medium can be distorted or chemically degraded. Thus the medium has to be designed to fit within the acceptable range of thermal imaging energies. Imaging time does not allow any great relief from this problem since imaging must be accomplished in a reasonable time for it to have practical use. For example, a seventeen inch image with 300 lines per inch resolution requires 5100 lines to be written per page. With a line write time of 15 milliseconds the whole page will be written in about 77 seconds. It is not acceptable to end users to wait much longer than this, indeed shorter times are preferred. Thus there is a need for developers with the fastest 'imaging speed' and any improvement in system speed will be of value to the end user.

SUMMARY OF THE INVENTION

One aspect of this invention comprises a thermographic imaging element comprising:

(a) a support; and (b) an imaging layer comprising:

(i) a oxidizing agent;

(ii) a first reducing agent; and (iii) a second reducing agent comprising a silicon compound containing at least one silicon-hydrogen bond.

ADVANTAGEOUS EFFECT OF THE INVENTION

This invention provides thermographic elements having improved speed.

DETAILED DESCRIPTION OF THE INVENTION

Figure 1:
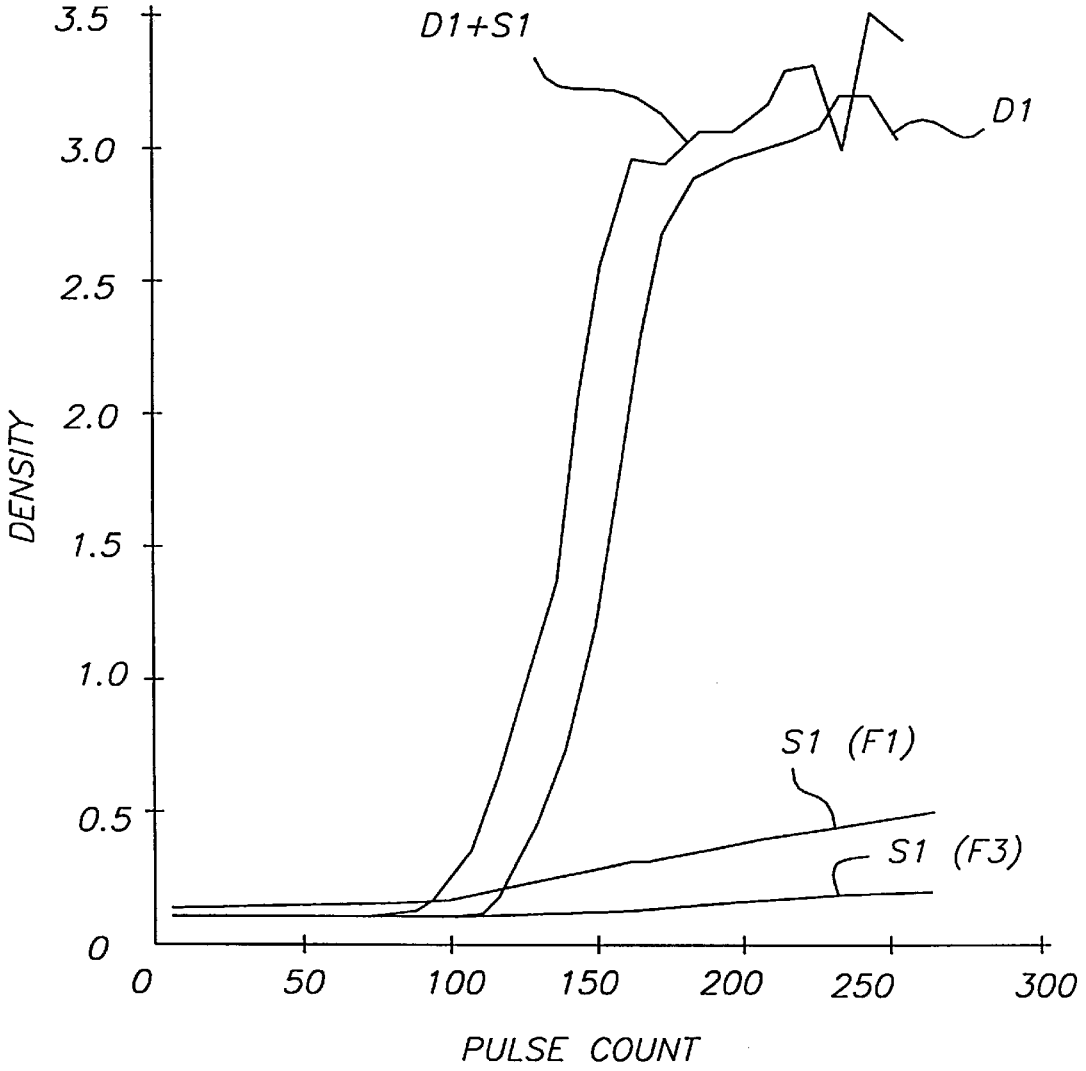
FIG. 1 shows the sensitometric curves obtained using a first reducing agent, a second reducing agent or a combination of a first reducing agent and a second reducing agent, as discussed more fully below.

The thermographic element and composition according to the invention comprise an oxidation-reduction image-forming composition which contains an oxidizing agent, a first reducing agent and a second reducing agent which comprises a silicon compound containing at least one silicon-hydrogen bond.

The oxidizing agent is preferably a silver salt of an organic acid. Suitable silver salts include, for example, silver behenate, silver stearate, silver oleate, silver laureate, silver hydroxy stearate, silver caprate, silver myristate, silver palmitate silver benzoate, silver benzotriazole, silver terephthalate, silver phthalate saccharin silver, phthalazinone silver, benzotriazole silver, silver salt of 3-(2-carboxyethyl-4-4-hydroxymethyl-4-thiazoline-2-thione, silver salt of 3-mercapto-4-phenyl-1,2,4-triazole and the like. In most instances silver behenate is most useful.

The first reducing agent can be selected from a variety of reducing agents (also known as developing agent or developer) known in the art for use in thermographic imaging elements. Preferred compounds for use as the first reducing agent include, for example:

(1) Sulfonamidophenol reducing agents in thermographic materials as described in U.S. Pat. No. 3,801,321 issued Apr. 2, 1974 to Evans et al., the entire disclosure of which is incorporated herein by reference, and sulfonamidoaniline reducing agents;

(2) Other reducing agents are substituted phenol and substituted naphthol reducing agents. Substituted phenols which can be used include, for example, bisphenols, e.g., bis(2-hydroxy-3-t-butyl-5-methylphenyl) methane, bis(6-hydroxy-m-tolyl)mesitol, 2,2-bis(4-hydroxy-3-methylphenyl)propane, 4,4-ethylidene-bis(2-t-butyl-6-methylphenol) and 2,2-bis (3,5-dimethyl-4-hydroxyphenyl) propane. Substituted naphthols which can be used include, for example, bis-b-naphthols such as those described in U.S. Pat. No. 3,672,904 of deMauriac, issued Jun. 27, 1972, the entire disclosure of which is incorporated herein by reference. Bis-b-naphthols which can be used include, for example, 2,2'-dihydroxy-1,1'-binaphthyl, 6,-6'-dibromo-2,2'-dihydroxy-1,1'-binaphthyl, 6,6'-dinitro-2,2'-dihydroxy-1,1'-binaphthyl, and bis-(2-hydroxy-1-naphthol) methane.

(3) Other reducing agents include polyhydroxybenzene reducing agents such as hydroquinone, alkyl-substituted hydroquinones such as tertiary butyl hydroquinone, methyl hydroquinone, 2,5-dimethyl hydroquinone and 2,6-dimethyl hydroquinone, (2,5-dihydroxyphenyl) methylsulfone, catechols and pyrogallols, e.g., pyrocatechol, 4-phenylpyrocatechol, t-butylcatechol, pyrogallol or pyrogallol derivatives such as pyrogallol ethers or esters; 3,4-dihydroxybenzoic acid, 3,4-dihydroxybenzoic acid, 3,4-dihydroxybenzoic acid esters such as dihydroxybenzoic acid, methyl ester, ethyl ester, propyl ester or butyl ester; gallic acid, gallic acid esters such as methyl gallate, ethyl gallate, propyl gallate and the like, gallic acid amides;

(4) aminophenol reducing agents, such as 2,4-diaminophenols and methylaminophenols can be used;

(5) ascorbic acid reducing agents such as ascorbic acid and ascorbic acid derivatives such as ascorbic acid ketals can be used;

(6) hydroxylamine reducing agents can be used;

(7) 3-pyrazolidone reducing agents such as 1-phenyl-3-pyrazolidone can be used;

(8) other reducing agents which can be used include, for example, hydroxycoumarones, hydroxycoumarans, hydrazones, hydroxaminic acids, indane-1,3-diones, aminonaphthols, pyrazolidine-5-ones, hydroxylamines, reductones, esters of amino reductones, hydrazines, phenylenediamines, hydroxyindanes, 1,4-dihydroxypyridines, hydroxy-substituted aliphatic carboxylic acid arylhydrazides, N-hydroxyureas, phosphonamidephenols, phosphonamidanilines, α-cyanophenylacetic esters sulfonamidoanilines, aminohydroxycycloalkenone compounds, N-hydroxyurea derivatives, hydrazones of aldehydes and ketones, sulfhydroxamic acids, 2-tetrazolythiohydroquinones, e.g., 2-methyl-5-(1-phenyl-5-tetrazolythio) hydroquinone, tetrahydroquinoxalines, e.g. 1,2,3,4-tetrahydroquinoxaline, amidoximes, azines, hydroxamic acids, 2-phenylindan-1,3-dione, 1,4-dihydropyridines, such as 2,6-dimethoxy-3,5-dicarbethoxy-1,4-dihydropyridine. Illustrative compounds for use as the first reducing agent are listed in Table 1.

TABLE 1

Illustrative First Reducing Agents

| ID | Formula |
|---|---|
| D1 | 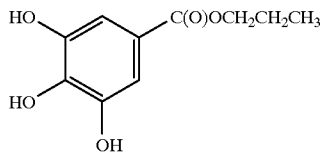 |
| D2 | 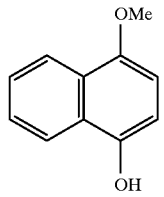 |
| D3 | 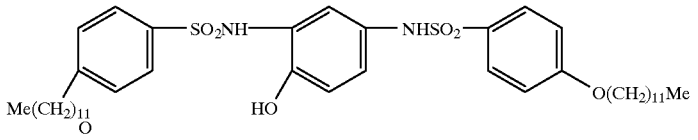 |
| D4 | 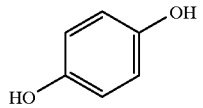 |
| D5 | 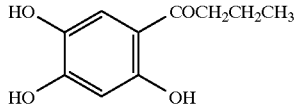 |
| D6 | 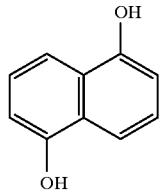 |

TABLE 1-continued
Illustrative First Reducing Agents
| ID | Formula |
|---|---|
| D7 | 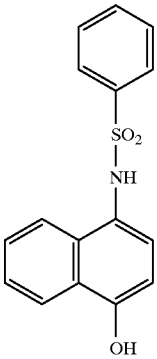 |
| D8 | 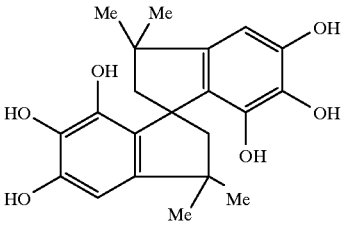 |
| D9 | 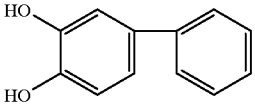 |
| D10 | 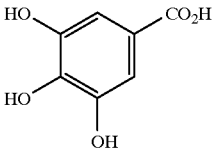 |
| D11 | 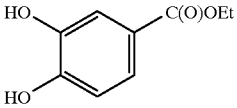 |
| D12 | 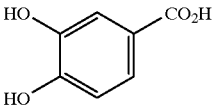 |
| D13 | 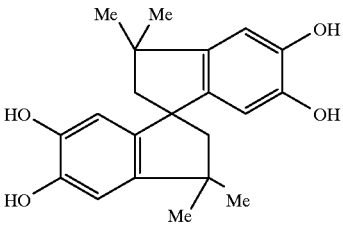 |

TABLE 1-continued

| Illustrative First Reducing Agents | |
|---|---|
| ID | Formula |
| D14 | 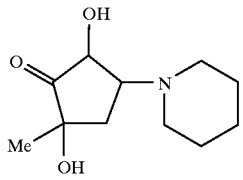 |

The amount of first reducing agent used in the thermal imaging material of this invention is preferably about 0.05 to about 5 moles/mole Ag, more preferably about 0.1 to about 2 and most preferable about 0.5 to about 1.5 moles/mole Ag.

Silicon compounds useful in the practice of this invention are represented by the general Structures I and II, below:

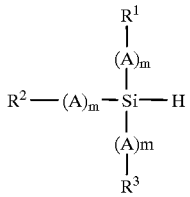

I wherein:

$R^1$, $R^2$ and $R^3$ can be the same or different, and are selected from the group consisting of hydrogen, halogen, alkyl, cycloalkyl, arylalkyl, and aryl; or $R^1$ and $R^2$, $R^2$ and $R^3$, or $R^1$ and $R^3$ or $R^1$, $R^2$ and $R^3$, are joined to form one or more ring sturcutres, or at least 1 of $R^1$, $R^2$ or $R^3$ is a polymer backbone; A is a non-carbon atom, such as N, O, P, S; and m is 0 or 1.

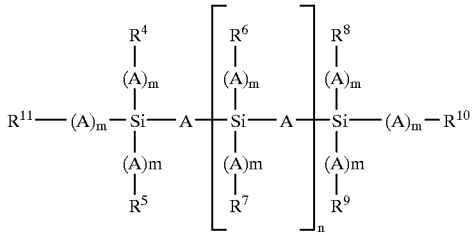

II wherein:

n is 0–5000, preferably 1–1000, most preferably 1–35.

m is 0 or 1

A is noncarbon element, such as N, S, P, O, preferably O;

$R^4$–$R^{11}$ are independently hydrogen, halogen, alkyl, cycloalkyl, arylalkyl, aryl; with the proviso that at least one of $R^4$–$R^{11}$ is a hydrogen atom directly bonded to the silicon atom to which it is attached.

When reference in this application is made to a particular moiety as a "group", this means that the moiety may itself be unsubstituted or substituted with one or more substituents (up to the maximum possible number). For example, "alkyl group" refers to a substituted or unsubstituted alkyl, while "benzene group" refers to a substituted or unsubstituted benzene (with up to six substituents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms, for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid groups, such as carboxy or sulfo groups, sulfoamino groups, amido groups, carboxy ester groups, and the like. With regard to any alkyl group or alkylene group, it will be understood that these can be branched or unbranched and include ring structures.

Preferred silicon compounds include, for example, the silicon compounds S1 and S2 which are shown in Table 2. Comparative silicon-containing compounds C1 and C2, which do not containing a silicon-hydrogen bond, are also shown in Table 2.

TABLE 2

| Silicon Compound | |
|---|---|
| ID | |
| S1 | 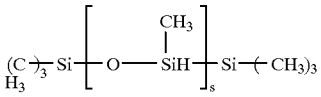 wherein s is 1 to about 500, preferably about 10 to about 2000, and most preferably about 10 to about 1000. |
| S2 | 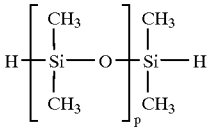 wherein p is 1 to about 500, preferably about 1 to about 200 and most preferably 1 to about 50. |

TABLE 2-continued
| ID | Silicon Compound |
|---|---|
| S3 | 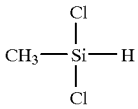 |
| S4 | 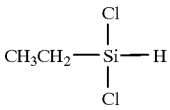 |
| S5 | 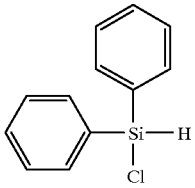 |
| S6 | 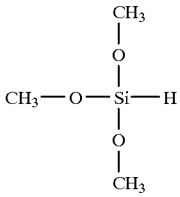 |
| S7 | 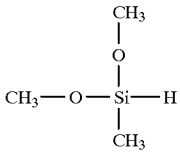 |
| S8 | 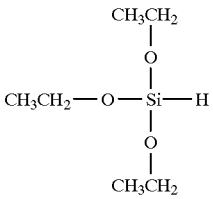 |
| S9 | 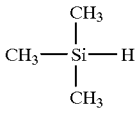 |
| S10 | 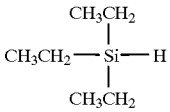 |
| S11 | 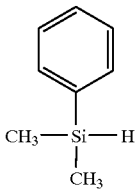 |
TABLE 2-continued
| ID | Silicon Compound |
|---|---|
| S12 | 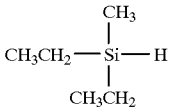 |
| S13 | 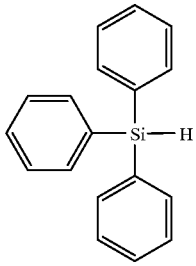 |
| S14 | 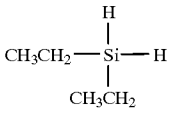 |
| S15 | 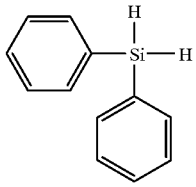 |
| S16 | 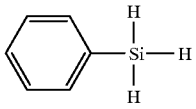 |
| S17 | 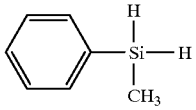 |
| S18 | 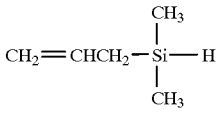 |
| S19 | 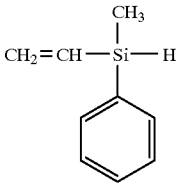 |
| S20 | 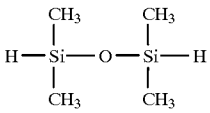 |

TABLE 2-continued

| ID | Silicon Compound |
|---|---|
| S21 | 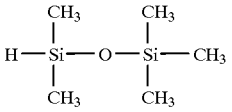 |
| S22 | 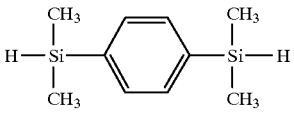 |
| S23 | 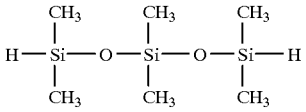 |
| S24 | 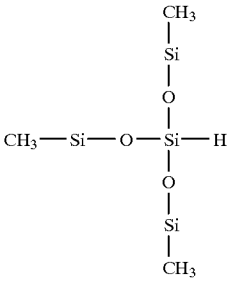 |
| S25 | $(CH_3O—Si—H)_5$ |
| S26 | 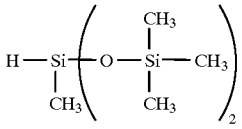 |
| C1 (Comparative) | 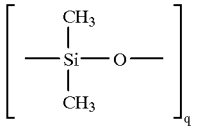 wherein q is about 10 to about 5000 |
| C2 (Comparative) | 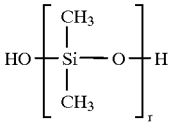 wherein r is about 10 to about 5000. |

The amount of silicon compound used in the thermal imaging material of this invention is preferably about 0.005 to about 2 moles/mole Ag, more preferably about 0.005 to about 0.5 and most preferable about 0.005 to about 0.2 moles/mole Ag.

The imaging element of the invention can also contain a so-called activator-toning agent, also known as an accelerator-toning agent or toner. The activator-toning agent can be a cyclic imide and is typically useful in a range of concentration such as a concentration of about 0.10 mole to about 1.1 mole of activator-toning agent per mole of silver salt oxidizing agent in the thermographic material. Typical suitable activator-toning agents are described in Belgian Patent No. 766,590 issued Jun. 15, 1971, the entire disclosure of which is incorporated herein by reference. Typical activator-toning agents include, for example, phthalimide, N-hydroxyphthalimide, N-hydroxy-1,8-naphthalimide, N-potassium phthalimide, N-mercury phthalimide, succinimide and/or N-hydroxysuccinimide. Combinations of activator-toning agents can be employed if desired. Other activator-toning agents which can be employed include phthalazinone, 2-acetylphthalazinone and the like.

The thermographic imaging composition of the invention can contain other addenda that aid in formation of a useful image.

A thermographic composition of the invention can contain various other compounds alone or in combination as vehicles, binding agents and the like, which can be in various layers of the thermographic element of the invention. Suitable materials can be hydrophobic or hydrophilic. They are transparent or translucent and include such synthetic polymeric substances as water soluble polyvinyl compounds like poly(vinyl pyrrolidone), acrylamide polymers and the like. Other synthetic polymeric compounds which can be employed include dispersed vinyl compounds such as in latex form and particularly those which increase dimensional stability of photographic materials. Effective polymers include water insoluble polymers of polyesters, polycarbonates, alkyl acrylates and methacrylates, acrylic acid, sulfoalkyl acrylates, methacrylates and those which have crosslinking sites which facilitate hardening or curing as well as those having recurring sulfobetaine units as described in Canadian Patent No. 774,054, the entire disclosure of which is incorporated herein by reference. Especially useful high molecular weight materials and resins include poly(vinyl acetals), such as, poly(vinyl acetal) and poly(vinyl butyral), cellulose acetate butyrate, polymethyl methacrylate, poly(vinyl pyrrolidone), ethylcellulose, polystyrene, polyvinyl chloride, chlorinated rubber, polyisobutylene, butadiene-styrene copolymers, vinyl chloride-vinyl acetate copolymers, copolymers, of vinyl acetate, vinyl chloride and maleic acid and polyvinyl alcohol.

A thermographic element according to the invention comprises a thermal imaging composition, as described above, on a support. A wide variety of supports can be used. Typical supports include cellulose nitrate film, cellulose ester film, poly(vinyl acetal) film, polystyrene film, poly(ethylene terephthalate) film, polycarbonate film and related films or resinous materials, as well as glass, paper, metal and the like supports which can withstand the processing temperatures employed according to the invention. Typically, a flexible support is employed.

The thermographic imaging elements of the invention can be prepared by coating the layers on a support by coating procedures known in the photographic art, including dip coating, air knife coating, curtain coating or extrusion coating using hoppers. If desired, two or more layers are coated simultaneously.

Thermographic imaging elements are described in general in, for example, U.S. Pat. Nos. 3,457,075; 4,459,350; 4,264,725 and 4,741,992 and *Research Disclosure*, June 1978, Item No. 17029.

The components of the thermographic element can be in any location in the element that provides the desired image. If desired, one or more of the components can be in more than one layer of the element. For example, in some cases, it is desirable to include certain percentages of the reducing agent, toner, stabilizer and/or other addenda in an overcoat layer. This, in some cases, can reduce migration of certain addenda in the layers of the element.

The thermographic imaging element of the invention can contain a transparent, image insensitive protective layer. The protective layer can be an overcoat layer, that is a layer that overlies the image sensitive layer(s), or a backing layer, that is a layer that is on the opposite side of the support from the image sensitive layer(s). The imaging element can contain both a protective overcoat layer and a protective backing layer, if desired. An adhesive interlayer can be imposed between the imaging layer and the protective layer and/or between the support and the backing layer. The protective layer is not necessarily the outermost layer of the imaging element.

The protective overcoat layer preferably acts as a barrier layer that not only protects the imaging layer from physical damage, but also prevents loss of components from the imaging layer. The overcoat layer preferably comprises a film forming binder, preferable a hydrophilic film forming binder. Such binders include, for example, crosslinked polyvinyl alcohol, gelatin, poly(silicic acid), and the like. Particularly preferred are binders comprising poly(silicic acid) alone or in combination with a water-soluble hydroxyl-containing monomer or polymer as described in the above-mentioned U.S. Pat. No. 4,828,971, the entire disclosures of which are incorporated herein by reference.

The thermographic imaging element of this invention can include a backing layer. The backing layer is an outermost layer located on the side of the support opposite to the imaging layer. It is typically comprised of a binder and a matting agent which is dispersed in the binder in an amount sufficient to provide the desired surface roughness and the desired antistatic properties.

The backing layer should not adversely affect sensitometric characteristics of the thermographic element such as minimum density, maximum density and photographic speed.

The thermographic element of this invention preferably contains a slipping layer to prevent the imaging element from sticking as it passes under the thermal print head. The slipping layer comprises a lubricant dispersed or dissolved in a polymeric binder. Lubricants that can be used include, for example:

(1) a poly(vinyl stearate), poly(caprolactone) or a straight chain alkyl or polyethylene oxide perfluoroalkylated ester or perfluoroalkylated ether as described in U.S. Pat. No. 4,717,711, the disclosure of which is incorporated by reference.

(2) a polyethylene glycol having a number average molecular weight of about 6000 or above or fatty acid esters of polyvinyl alcohol, as described in U.S. Pat. No. 4,717,712 the entire disclosure of which is incorporated herein by reference;

(3) a partially esterified phosphate ester and a silicone polymer comprising units of a linear or branched alkyl or aryl siloxane as described in U.S. Pat. No. 4,737,485 the entire disclosure of which is incorporated herein by reference;

(4) a linear or branched aminoalkyl-terminated poly (dialkyl, diaryl or alkylaryl siloxane) such as an aminopropyldimethylsiloxane or a T-structure polydimethylsiloxane with an aminoalkyl functionality at the branch-point, as described in U.S. Pat. No. 4,738,950, the entire disclosure of which is incorporated herein by reference;

(5) solid lubricant particles, such as poly (tetrafluoroethylene), poly(hexafluoropropylene) or poly (methylsilylsesquioxane, as described in U.S. Pat. No. 4,829,050, the entire disclosure of which is incorporated herein by reference;

(6) micronized polyethylene particles or micronized polytetrafluoroethylene powder as described in U.S. Pat. No. 4,829,860, the entire disclosure of which is incorporated herein by reference;

(7) a homogeneous layer of a particulate ester wax comprising an ester of a fatty acid having at least 10 carbon atoms and a monohydric alcohol having at least 6 carbon atoms, the ester wax having a particle size of from about 0.5 mm to about 20 mm, as described in U.S. Pat. No. 4,916,112, the entire disclosure of which is incorporated herein by reference;

(8) a phosphonic acid or salt as described in U.S. Pat. No. 5,162,292, the entire disclosure of which is incorporated herein by reference;

(9) a polyimide-siloxane copolymer, the polysiloxane component comprising more than 3 weight % of the copolymer and the polysiloxane component having a molecular weight of greater than 3900, the entire disclosure of which is incorporated herein by reference;

(10) a poly(aryl ester, aryl amide)-siloxane copolymer, the polysiloxane component comprising more than 3 weight % of the copolymer and the polysiloxane component having a molecular weight of at least about 1500, the entire disclosure of which is incorporated herein by reference.

In the thermographic imaging elements of this invention can contain either organic or inorganic matting agents. Examples of organic matting agents are particles, often in the form of beads, of polymers such as polymeric esters of acrylic and methacrylic acid, e.g., poly (methylmethacrylate), styrene polymers and copolymers, and the like. Examples of inorganic matting agents are particles of glass, silicon dioxide, titanium dioxide, magnesium oxide, aluminum oxide, barium sulfate, calcium carbonate, and the like. Matting agents and the way they are used are further described in U.S. Pat. Nos. 3,411,907 and 3,754,924.

The concentration of matting agent required to give the desired roughness depends on the mean diameter of the particles and the amount of binder. Preferred particles are those with a mean diameter of from about 1 to about 15 micrometers, preferably from 2 to 8 micrometers. The matte particles can be usefully employed at a concentration of about 1 to about 100 milligrams per square meter.

The imaging element can also contain an electroconductive layer which, in accordance with U.S. Pat. No. 5,310,640, is an inner layer that can be located on either side of said support. The electroconductive layer preferably has an internal resistivity of less than $5\times10^{11}$ ohms/square.

The protective overcoat layer and the slipping layer may either or both be electrically conductive having a surface resistivity of less than $5\times10^{11}$ ohms/square. Such electrically conductive overcoat layers are described in U.S. Pat. No. 5,547,821, incorporated herein by reference. As taught in the '821 patent, electrically conductive overcoat layers comprise metal-containing particles dispersed in a polymeric binder in an amount sufficient to provide the desired surface resistivity. Examples of suitable electrically-conductive metal-containing particles for the purposes of this invention include:

(1) donor-doped metal oxide, metal oxides containing oxygen deficiencies, and conductive nitrides, carbides, and borides. Specific examples of particularly useful particles include conductive $TiO_2$, $SnO_2$, $V_2O_5$, $Al_2O_3$, $ZrO_2$, $In_2O_3$, ZnO, $TiB_2$, $ZrB_2$, $NbB_2$, $TaB_2$, $CrB_2$, MoB, WB, $LaB_6$, ZrN, TiN, TiC, WC, HfC, HfN, ZrC. Examples of the many patents describing these electrically-conductive particles include U.S. Pat. Nos. 4,275,103, 4,394,441, 4,416,963, 4,418,141, 4,431,764, 4,495,276, 4,571,361, 4,999,276, and 5,122,445;

(2) semiconductive metal salts such as cuprous iodide as described in U.S. Pat. Nos. 3,245,833, 3,428,451 and 5,075,171;

(3) a colloidal gel of vanadium pentoxide as described in U.S. Pat. Nos. 4,203,769, 5,006,451, 5,221,598, and 5,284,714; and (4) fibrous conductive powders comprising, for example, antimony-doped tin oxide coated onto non-conductive potassium titanate whiskers as described in U.S. Pat. Nos. 4,845,369 and 5,116,666.

To determine the activity of a reducing agent the following procedure is conducted. Test formulation #1 is prepared, coated on a support and imaged using a thin film thermal head in contact with a combination of the imaging medium and a protective film of 6 micron polyester sheet. Contact of the head to the element is maintained by an applied pressure of 313 g/cm heater line. The line write time is 15 milliseconds broken up into 255 increments corresponding to the pulse width. Energy per pulse is 0.0413 Joule per sq. cm.

| FORMULATION #1-SINGLE REDUCING AGENT ACTIVITY | |
|---|---|
| SILVER BEHENATE | 9.5 millimole/$m^2$ |
| POLY(VINYL BUYRAL) | 4320 milligram/$m^2$ |
| SUCCINIMIDE | 8.6 millimole/$m^2$ |
| TEST MATERIAL | 8.2 millimole/$m^2$ |

In the case of polymeric materials under test the molecular weight is taken to be that of the repeating unit of the polymer. Table 3 gives the maximum image density (maximum measured density minus support density) and the characteristic energy E1 defined as the energy in Joules/sq.cm required to achieve the onset of imaging defined as a density of 0.1 above Dmin.

The energy of silicon compounds S1, S2, C1 and C2 are listed in Table 3.

TABLE 3

Silicon Compounds as Reducing Agents

| ID | Max Image Density | E1 |
|---|---|---|
| S1 | 0.379 | 5.40 |
| S2 | 0.353 | 7.55 |
| C1 | 0.030 | * |
| C2 | 0.029 | * |

*C1 and C2 did not reach a density of 0.1 above D min, thus showing the comparative silicon compounds have no reducing agent effect.

EXAMPLE 1

To determine the activity of a combination of conventional developer (i.e. the "first reducing agent" herein) and the silicon compounds the following procedure is conducted. Test formulation #2 is coated on a support and imaged exactly as before for all combinations of silicon compound and developer. For comparison—formulation #1 is prepared, coated and tested for each conventional developer. The E1 values of the mixtures are then compared to the conventional developer by itself.

| FORMULATION #2-MIXTURE ACTIVITY | |
|---|---|
| SILVER BEHENATE | 9.5 millimole/$m^2$ |
| POLY(VINYL BUYRAL) | 4320 milligram/$m^2$ |
| SUCCINIMIDE | 8.6 millimole/$m^2$ |
| TEST MATERIAL | 1.08 millimole/$m^2$ |
| CONV. DEVELOPER(D1, D2) | 7.02 millimole/$m^2$ |

TABLE 4

Silicon Compound/Developer Combinations

| Developer ID | Silicon Comp'd ID | Dmax | E1 | Speed Gain |
|---|---|---|---|---|
| D1 | None | 3.2 | 5.3 | |
| D1 | S1 | 3.5 | 4.5 | +0.8 |
| D1 | S2 | 3.3 | 5.1 | +0.2 |
| D1 | C1 | 3.4 | 5.3 | 0.0 |
| D1 | C2 | 3.7 | 5.2 | +0.1 |
| D2 | None | 3.2 | 6.2 | |
| D2 | S1 | 3.5 | 5.6 | +0.6 |
| D2 | S2 | 3.3 | 5.4 | +0.8 |
| D2 | C1 | 3.4 | 6.3 | −0.1 |
| D2 | C2 | 3.7 | 6.2 | 0.0 |

Silicon compounds useful in the invention, S1 and S2, show consistent behavior. The silicon compound itself has some activity when tested as a developer. When added as a minor ingredient to a more conventional developer (i.e., a first developer) the speed of the system is greater (lower energy to achieve onset of imaging) than either the developer or the silicon compound second developer by itself.

Silicon compounds which are not of the invention, C1 and C2, likewise show a consistent pattern of behavior. When tested as a developer there is no significant density generated and no E1 value can be assigned. When added to a conventional developer the change in speed is essentially zero.

Table 5 shows the E1 values obtained by various reducing agents, alone using formulation #1 and in combination with S1 using formulation #2. In every case the addition of S1 causes a speed gain i.e. a reduction in the energy required for the onset of imaging.

TABLE 5

Various Developers with Silicon Compound S1

| | Formulation #1-without S1 | Formulation #2-with S1 | Speed Gain |
|---|---|---|---|
| D3 | 6.8 | 6.1 | +0.6 |
| D4 | 7.7 | 4.2 | +3.5 |
| D5 | 5.4 | 4.0 | +1.4 |
| D6 | 8.2 | 5.2 | +3.0 |
| D7 | 7.5 | 5.4 | +2.1 |
| D8 | 4.3 | 4.1 | +0.2 |
| D9 | 5.2 | 4.0 | +1.2 |
| D10 | 5.6 | 4.9 | +0.7 |
| D11 | 6.6 | 5.0 | +1.5 |
| D12 | 6.8 | 5.0 | +1.8 |
| D13 | 5.0 | 4.3 | +0.8 |
| D14 | 8.4 | 6.1 | +2.3 |

As a further demonstration of the beneficial effects of the combination of materials, formulation #3 was prepared and coated and imaged exactly as the other materials.

| FORMULATION #3 | |
|---|---|
| SILVER BEHENATE | 9.5 millimole/$m^2$ |
| POLY(VINYL BUYRAL) | 4320 milligram/$m^2$ |
| SUCCINIMIDE | 8.6 millimoLe/$m^2$ |
| TEST MATERIAL (S1) | 1.08 millimole/$m^2$ |

FIG. 1 shows the sensitometric curves of materials containing:

D1 as the only developer;

S1 as the only developer at the level used in formulation #1 (F1);

S1 as the only developer at the level used in formulation #3 (F3);

and both S1 and D1 as given in Table 4 (formulation #2).

As can be seen in in FIG. 1 when S1 and D1 are used in combination the speed gain results in a general shift of the entire sensitometric curve not just the "toe" portion.

The invention has been described in detail with particular reference to preferred embodiments, but it will be understood that variations and modifications can be effected within the spirit and scope of the invention.

What is claimed is:

1. A thermographic imaging element comprising:

(a) a support; and (b) an imaging layer comprising:

(i) a silver salt of an organic acid;

(ii) a first reducing agent; and (iii) a second reducing agent comprising a silicon compound containing at least one silicon-hydrogen bond.

2. An imaging element according to claim 1, wherein the silver salt is silver behenate.

3. An imaging element according to claim 1, wherein the first reducing agent is selected from the following reducing agents: sulfonamidophenols; substituted phenol and substituted naphthols; polyhydroxybenzenes; aminophenols; ascorbic acids; hydroxylamines; 3-pyrazolidones; hydroxycoumarones; hydroxycoumarans; hydrazones; hydroxaminic acids, indane-1,3-diones; aminonaphthols; pyrazolidine-5-ones; hydroxylamines; reductones; esters of amino reductone, hydrazines; phenylenediamines; hydroxyindane; 1,4-dihydroxypyridines; hydroxy-substituted aliphatic carboxylic acid arylhydrazides; N-hydroxyureas, phosphonamidephenols; phosphonamidanilines; α-cyanophenylacetic esters sulfonamidoanilines; aminohydroxycycloalkenone compounds; N-hydroxyurea derivatives; hydrazones of aldehydes and ketones; sulfhydroxamic acids; 2-tetrazolythiohydroquinones; tetrahydroquinoxalines; amidoximes; azines; hydroxamic acids; 2-phenylindan-1,3-dione; and 1,4-dihydropyridines.

4. An imaging element according to claim 1, wherein the first reducing agent is selected from:

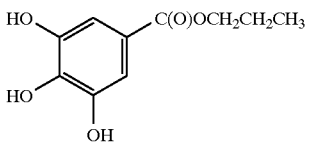

-continued

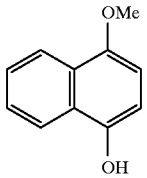

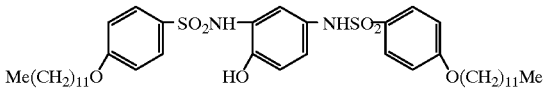

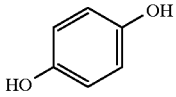

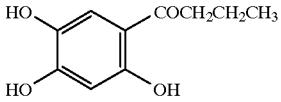

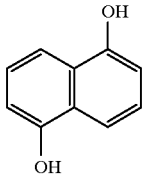

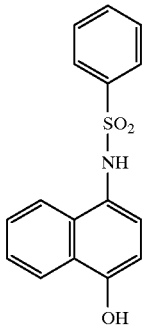

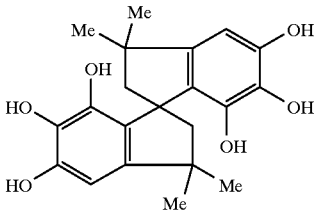

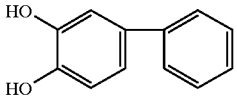

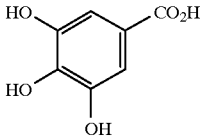

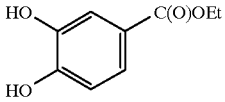

-continued

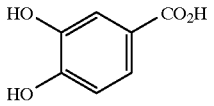

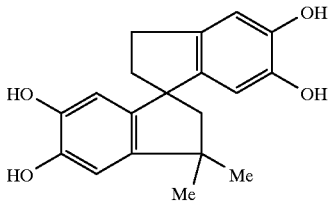

and

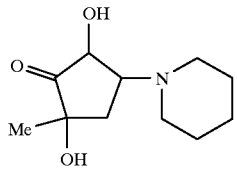

5. An imaging element according to claim 1, wherein the first reducing agent is present in an amount of about 0.05 to about 5 moles/mole Ag.

6. An imaging element according to claim 1, wherein the second reducing agent is a silicon compound of Structure I or Structure II:

I

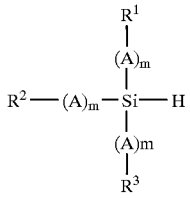

wherein:

$R^1$, $R^2$ and $R^3$ can be the same or different, and are selected from the group consisting of hydrogen, halogen, alkyl, cycloalkyl, arylalkyl, and aryl; or $R^1$ and $R^2$, $R^2$ and $R^3$, or $R^1$ and $R^3$ or $R^1$, $R^2$ and $R^3$, are joined to form one or more ring sturcutres, or at least 1 of $R^1$, $R^2$ or $R^3$ is a polymer backbone; A is a noncarbon atom, such as N, O, P, S; and m is 0 or 1;

II

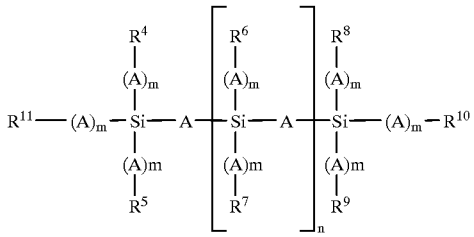

wherein:

n is 0–5000, preferably 0–1000, most preferably 0–35;

m is 0 or 1;

A is noncarbon element, such as N, S, P, O, preferably O;

$R^4$–$R^{11}$ are independently hydrogen, halogen, alkyl, cycloalkyl, arylalkyl, aryl; with the proviso that at least one of $R^4$–$R^{11}$ is a hydrogen atom directly bonded to the silicon atom to which it is attached.

7. An imaging element according to claim 1, wherein the characteristic energy, E1, of the silicon compound it between about 5 to about 8 Joules/sq.cm.

8. An imaging element according to claim 1, wherein the silicon compound is of the formula:

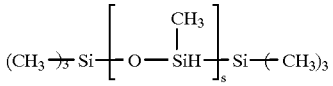

or

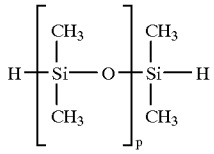

wherein s is 1 to about 5000 and p is 1 to about 500.

9. An imaging element according to claim 8, wherein the silicon compound is of the formula:

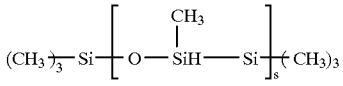

wherein s is about 25 to about 50.

10. An imaging element according to claim 8, wherein the silicon compound is of the formula:

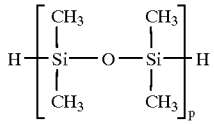

wherein p is about 5 to about 50.

11. An imaging element according to claim 1, wherein the second reducing agent is present in an amount of about 0.005 to about 2 moles/mole Ag.

12. An imaging element according to claim 1, wherein the first reducing agent is:

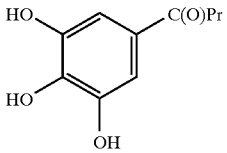

or

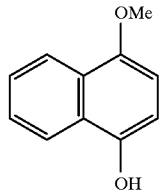

;

and the second reducing agent is:
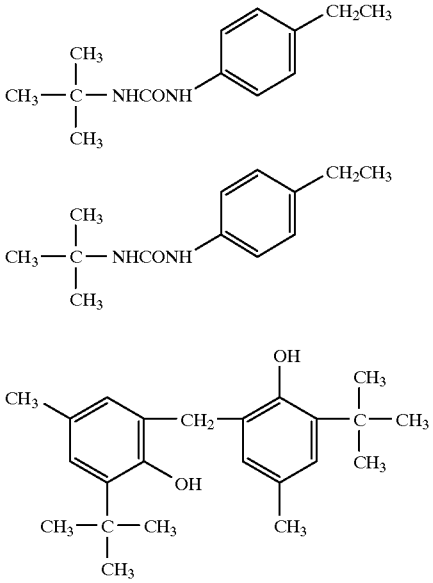
-continued
or
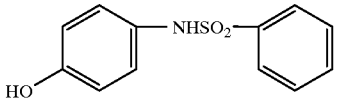
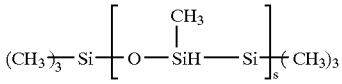
or
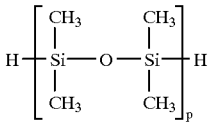
wherein s is 1 to about 5000 and p is 1 to about 500.
* * * * *